US006826384B2

(12) United States Patent
Dobbertin et al.

(10) Patent No.: US 6,826,384 B2
(45) Date of Patent: Nov. 30, 2004

(54) APPARATUS FOR A PRE-REGISTRATION SPEED AND TIMING ADJUST SYSTEM

(75) Inventors: Michael T. Dobbertin, Honeoye, NY (US); Alan E. Rapkin, Pittsford, NY (US); Thomas K. Sciurba, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/668,860

(22) Filed: Sep. 23, 2003

(65) Prior Publication Data

US 2004/0062582 A1 Apr. 1, 2004

Related U.S. Application Data

(60) Provisional application No. 60/414,788, filed on Sep. 27, 2002.

(51) Int. Cl.[7] ..... G03G 15/00
(52) U.S. Cl. ..... 399/394
(58) Field of Search ..... 399/394, 396

(56) References Cited

U.S. PATENT DOCUMENTS

| | | | |
|---|---|---|---|
| 4,362,378 | A | 12/1982 | Erskine et al. |
| 4,416,534 | A | 11/1983 | Kluger |
| 4,589,765 | A | 5/1986 | Perun et al. |
| 4,826,148 | A | 5/1989 | Coons, Jr. |
| 4,971,304 | A | 11/1990 | Lofthus |
| 5,057,874 | A | 10/1991 | Miyazaki et al. |
| 5,112,038 | A | 5/1992 | Dunaway |
| 5,260,757 | A | 11/1993 | Frank et al. |
| 5,273,274 | A | 12/1993 | Thomson et al. |
| 5,322,273 | A | 6/1994 | Rapkin et al. |
| 5,362,041 | A | 11/1994 | Ryuzaki et al. |
| 5,415,387 | A | 5/1995 | Suzuki |
| 5,678,159 | A | 10/1997 | Williams et al. |
| 5,689,795 | A | 11/1997 | Mastrandrea |
| 5,697,608 | A | 12/1997 | Castelli et al. |
| 5,697,609 | A | 12/1997 | Williams et al. |
| 5,715,514 | A | 2/1998 | Williams et al. |
| 5,725,211 | A | 3/1998 | Blanchard et al. |
| 5,732,943 | A | 3/1998 | Delfosse |
| 5,887,996 | A | 3/1999 | Castelli et al. |
| 5,930,577 | A | 7/1999 | Forsthoefel et al. |
| 5,931,090 | A | 8/1999 | Ohkawa |
| 5,994,711 | A | 11/1999 | Seachman et al. |

(List continued on next page.)

FOREIGN PATENT DOCUMENTS

| | | |
|---|---|---|
| DE | 44 44 755 A1 | 8/1995 |
| EP | 0 994 397 A2 | 4/2000 |
| EP | 1 002 652 A2 | 5/2000 |

OTHER PUBLICATIONS

EP Search Report EP 03 02 0469.
Patent Abstracts of Japan 600770051.

*Primary Examiner*—Quana Grainger
(74) *Attorney, Agent, or Firm*—Kevin L. Leffel

(57) ABSTRACT

An image-production system includes a marking engine. The image-forming production system may also include an inserter. The marking engine includes a marking engine controller, a speed adjust system and a registration system. The registration system aligns sheets going to an imaging unit. The speed adjust system controller includes a speed adjust system controller. When at least one sheet approaches the speed adjust system, the marking engine controller transmits a synch pulse signal to the speed adjust system controller. The speed adjust system transmits a signal to the speed adjust system controller of the arrival time of the at least one sheet. The speed adjust system compares the measured arrival time with the synch pulse signal to adjust a speed and timing of the sheet before the sheet is transferred to the registration system.

18 Claims, 6 Drawing Sheets

U.S. PATENT DOCUMENTS 6,116,594 A 9/2000 Boost
6,137,989 A 10/2000 Quesnel
6,144,814 A 11/2000 Newell, Jr. et al.
6,148,172 A 11/2000 Kanda et al.
6,160,981 A 12/2000 Williams et al.
6,168,153 B1 1/2001 Richards et al.
6,168,333 B1 1/2001 Merz et al.
6,173,952 B1 1/2001 Richards et al.
6,397,035 B2 * 5/2002 Kataoka et al. ..... 399/388

* cited by examiner

APPARATUS FOR A PRE-REGISTRATION SPEED AND TIMING ADJUST SYSTEM

FIELD OF THE INVENTION

This invention generally relates to image-forming production systems. More particularly, this invention relates to improving the operation of a registration system in the image-forming production system.

BACKGROUND OF THE INVENTION

Image-forming production systems, such as high volume electrographic printers and copiers, are used to transfer images onto a plurality of sheets of paper or other medium. In a typical image-forming job, the image-forming production system transfers or prints one or more images onto one or more sheets. When multiple images are transferred, the image-forming process usually transfers the images to arrange the output sheets according to the image-forming job. The output sheet sequence typically corresponds to the image input sequence into the image-forming production system. This ordered input and corresponding output avoids the need to reassemble or otherwise compile the sheets.

Many image-forming production systems have a marking engine, an inserter, and a finisher device. The marking engine transfers or prints images onto the sheets. If required by the image-forming job, the inserter inserts a tab, preprinted sheet, a blank sheet or other stock sheet into the sheet output from the marking engine. The finisher device collects the output sheets to complete the image-forming job or prepare it for subsequent processing operations.

The marking engine usually includes image-forming equipment, a sheet feeder and a registration system. The sheet feeder provides the selected paper or other medium to the image-forming production system for transferring or printing an image at an imaging and registration system in the marking engine. The imaging system includes an imaging loop. The registration system aligns the paper to a photoconductor in the correct position, orientation and at the correct time. The selected paper may arrive at the registration system at any time from various parts of the image-forming production system. The impreciseness or variability at which the paper arrives at the registration system may impede the registration system from effectively aligning and orientating the paper before it is sent through the registration system. Moreover, in an electrographic marking engine, it is desirable to minimize the speed at which an image is processed and fused for a given throughput rate. This is accomplished by positioning the sheets relatively close to each other in the direction of feed. On the other hand, paper feeders generally desire a higher transport speed. This is because high-speed feeders use vacuum feeding due to its superior reliability and performance compared to other types of feeders. For maximum performance these vacuum type feeding systems require a significant time between sheets in order to safely acquire the sheet with vacuum prior to feeding. This is accomplished by transporting the sheet at higher speed while feeding, leaving more time between feeds for acquiring the next sheet. This speed is sometimes higher than that at which the registration system can reliably accommodate. Thus there is a conflict between the desired relatively lower speed of the imaging system and the desired higher speed for the sheet feeders.

Accordingly, there is a need for an image-forming production system that is able to transfer sheets of paper to a registration system, where the transfer occurs at a time that is coordinated with the timing of the registration system.

BRIEF SUMMARY OF THE INVENTION

The present invention is an apparatus and method that may be used in an image-forming production system that includes a marking engine. Such systems may also include a paper supply module, an inserter and a finisher device. The image-production system includes a marking engine that receives at least one sheet and preferably a plurality of sheets onto which an image is transferred. A sheet feeder that feeds the sheet to the marking engine at a first speed. The marking engine includes an imaging system that transfers the image onto the sheet. A registration system is upstream of the imaging system, which aligns the sheet to the imaging system and moves the sheet through the imaging system at a second speed. The marking engine has an output downstream of the imaging system. A speed adjust system is disposed upstream of the registration system. The speed adjust system is connected to receive the sheet from the sheet feeder at the first speed and output the sheet to the registration system at the second speed. Preferably the speed adjust system also determines the correct time to feed the at least one sheet to the registration system.

In a preferred embodiment, the marking engine includes a marking engine controller and a speed adjust system. The speed adjust system includes a speed adjust system controller. The marking engine transmits a synch pulse signal to the speed adjust system controller. The speed adjust system transmits a signal to the speed adjust system sensor upon the arrival of the sheet. The speed adjust system controller compares the measured arrival time with the synch pulse signal to adjust a speed of the sheet before the sheet is transferred to the registration system.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF SEVERAL VIEWS OF THE DRAWINGS

These and other advantages of the present invention will become more apparent as the following description is read in conjunction with the accompanying drawings, wherein.

DETAILED DESCRIPTION OF THE INVENTION

Figure 1:
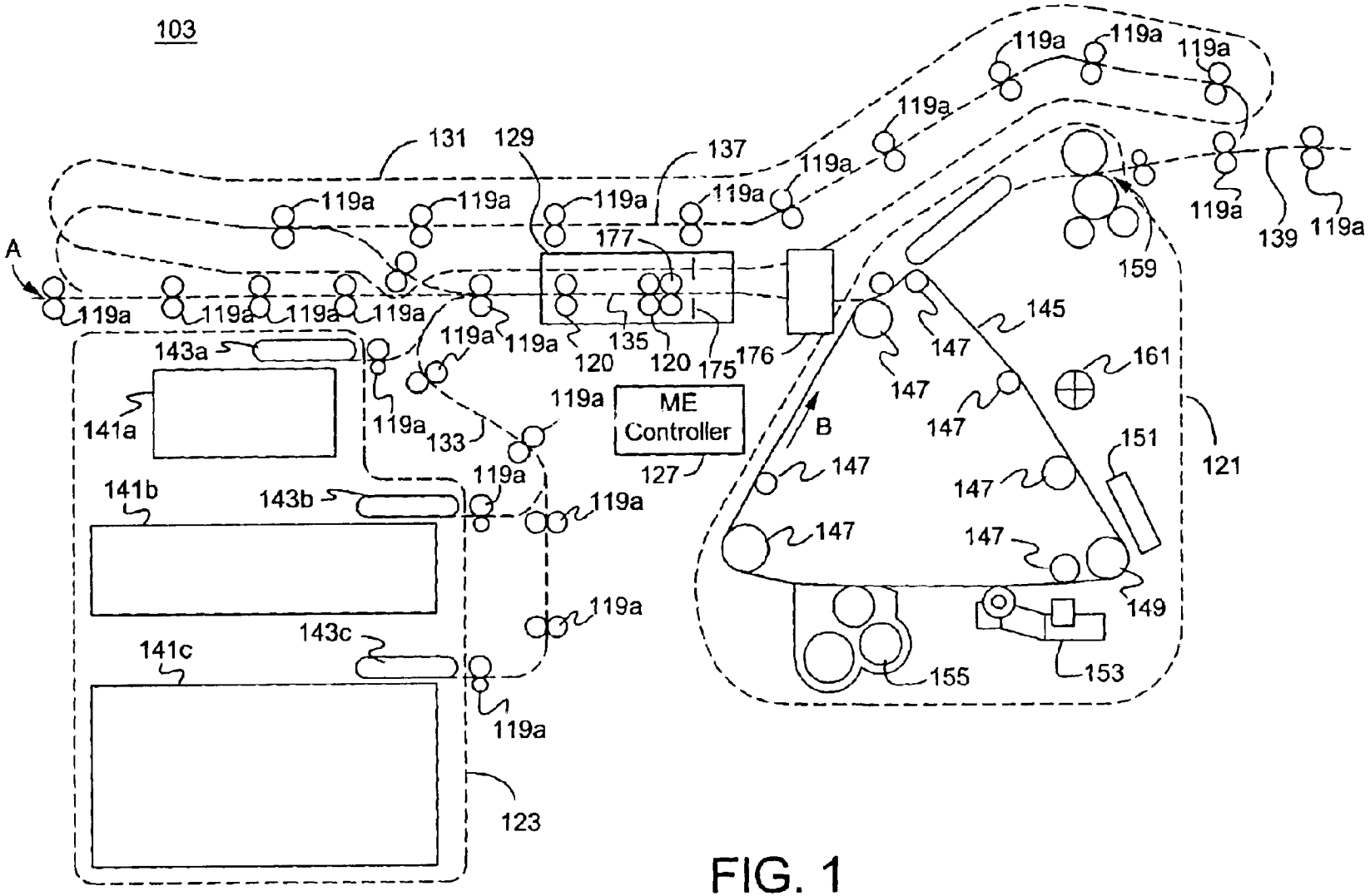
FIG. 1 is a schematic diagram of a preferred embodiment of a marking engine of the image-forming production system.

The present preferred embodiments of the invention are described herein with reference to the drawings, where like components are identified with the same reference numerals. These descriptions are intended to be exemplary, in nature and are not intended to limit the scope of the invention.

Figure 2:
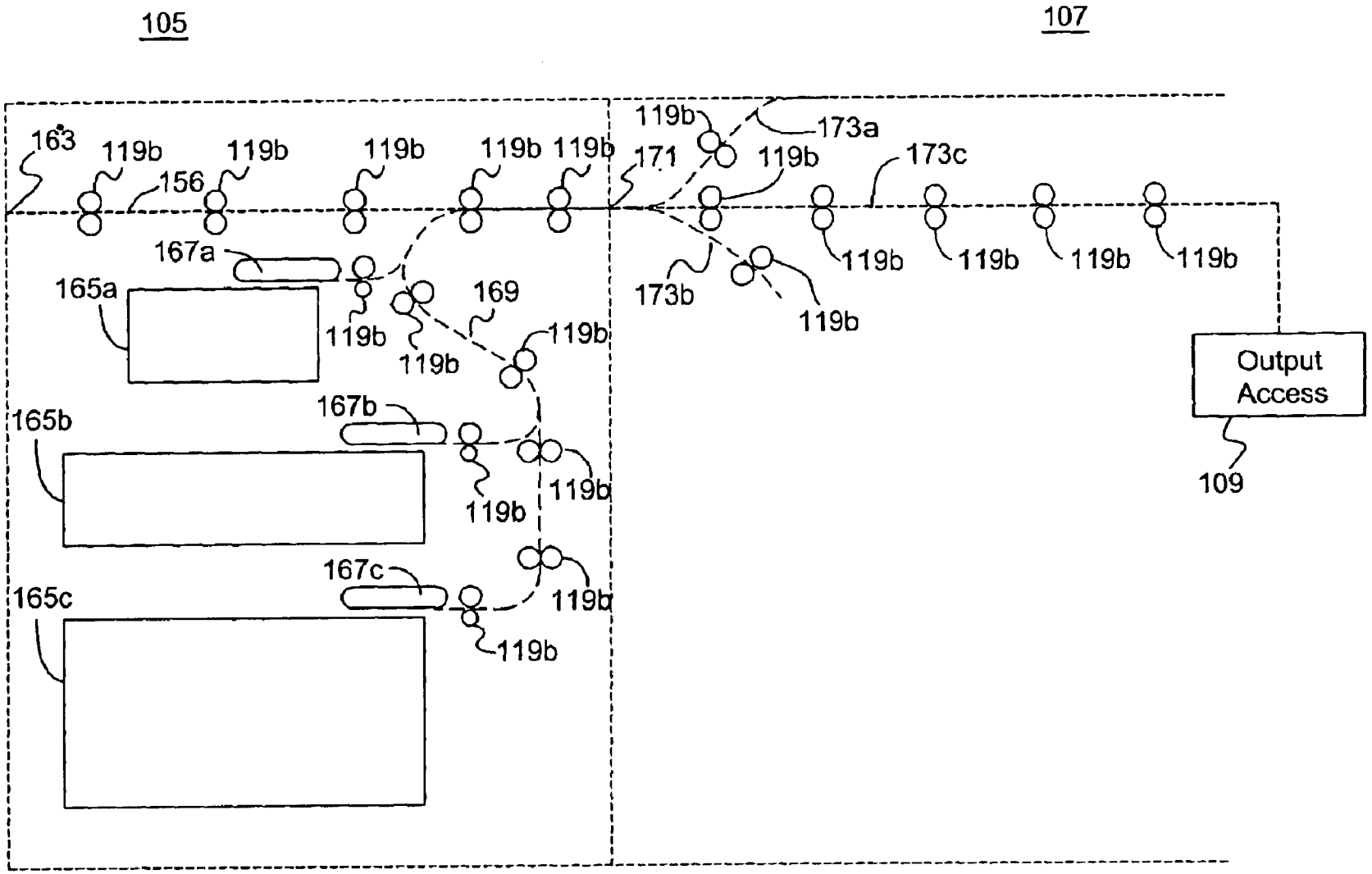
FIG. 2 is a schematic diagram of a preferred embodiment of an inserter and a finisher device of the image-forming production system.

Referring now to the figures, image-forming production system 100 includes: a marking engine 103 (FIG. 1), an inserter 105 (FIG. 2), a finisher device 107 (FIG. 2), and an output accessory 109 (FIG. 2).

FIG. 1 is a schematic diagram of a preferred embodiment of a marking engine of the image-forming production system. The marking engine 103 is a module that prints the desired image on the paper or other medium, it is also referred to as an electrophotographic process module. Preferably, the marking engine 103 includes an imaging unit 121, a feeder assembly 123 and a marking engine controller 127. Imaging unit 121 may also be referred to as an imaging system. The marking engine may also include an inverter 131 interconnected by paper transports 133, 135, 137 and 139. In this preferred embodiment, paper transport 135 receives the sheet from paper transport 133. A speed adjust system 129 includes a speed adjust system controller 125. The speed adjust system 129 adjusts the speed and preferably the timing of the sheets fed to a registration system 176.

The paper transports 133, 135, 137 and 139 may be any suitable conveyance mechanism for moving sheets throughout the marking engine 103. For example, the paper transports 133, 135, 137 and 139 may have roller sets, a belt, linked plate, or other suitable configuration. The paper transports 133, 135, 137 and 139 may be solid or perforated, and may work with pressurized air, a vacuum or combination system to keep the sheets in position such as against the paper transport. Guides and similar devices (not shown) may be present to divert or direct the sheets onto another paper transport or in a particular direction. The paper transports 133, 135, 137 and 139 operate in conjunction with paper transport rollers 119*a*, of which any one or more may be a motor driven roller. In the disclosed embodiment, the paper transport rollers 119*a* are configured in pairs oppositely disposed on the paper transports 133, 135, 137 and 139. The paper transport rollers 119*a* may have other configurations suitable for moving the sheets. Alternatively, the paper transports 133, 135, 137 and 139 may be a passage or path for the sheets to follow. The paper transport rollers 119*a* may be disposed such that at least one roller or one pair of rollers is in contact with each sheet at any position along the paper transports 133, 135, 137 and 139.

Preferably, feeder assembly 123 supplies paper or other medium to the imaging unit 121. The feeder assembly 123 is preferably of the vacuum feed type. As discussed above, vacuum feed is preferred because of its superior reliability and performance compared to other types of feeding devices. The marking engine 103 may have a feeder position A to bypass the feeder assembly 123. At feeder position A, a user may feed a sheet or other medium onto the input paper transport 135. The feeder assembly 123 includes one or more sheet storage bins 141*a*, 141*b*, and 141*c* having one or more paper feeder(s) 143*a*, 143*b*, and 143*c*, respectively. Paper feeders may be referred to as sheet feeders.

The sheet storage bins 141*a*, 141*b*, and 141*c* hold sheets of paper or other medium. There may be other multiples of sheet storage bins, including those of different sizes. The sheets may be the same, different and a combination of sizes. The sheets also may be the same, different and a combination of paper and other medium.

In operation, the paper feeders 143*a*, 143*b*, and 143*c* extract a sheet from the storage bins 141*a*, 141*b*, and 141*c* and dispense the sheet onto a paper transport 133. The paper transport 133 moves the sheet onto the input paper transport 135, which transports the sheet to the imaging unit 121.

The imaging unit 121 is the site in the marking engine 103 where the images are transferred or imprinted onto the sheets of paper. The imaging unit 121 may be a component of a copy machine, a facsimile machine, an electrophotographic image-forming machine, and the like.

A registration system assembly 176 aligns the sheet to the photoconductor or image loop in the correct position and orientation and at the correct time for imaging. For example, the registration system 176 corrects the skew, timing and crosstrack position of sheets before they are transferred to the image loop of the marking engine 103. More specifically, registration rollers in the registration system 176 adjusts the skew, timing and crosstrack position of the sheets so that paper arrives with appropriate orientation at the imaging unit 121. Registration system 176 may also be connected to marking engine controller 127. In one embodiment, the imaging unit 121 includes a photoconductor 145, support rollers 147, a motor driven roller 149, a primary charger 151, an exposure machine 153, a toning station 155, a fusing station 159, a cleaner 161, related equipment and accessories. The photoconductor 145 is operatively mounted on the support rollers 147. The motor driven roller 149 moves the photoconductor 145 in the direction indicated by arrow B. The primary charger 151, the exposure machine 153, the toning station 155, the fusing station 159, and the cleaner 161 are operatively disposed adjacent to the photoconductor 145. Preferably, the photoconductor 145 has a belt and roller-mounted configuration, but may have a drum or other suitable configuration.

To form an image, the primary charger 151 electrostatically charges the photoconductor 145 and the exposure machine 153 optically exposes and forms an electrostatic image on the photoconductor 145. The toning station 155 applies charged toner on the photoconductor 145. The charge on the toner causes it to adhere to the electrostatic image. A transfer charger (not shown) transfers the toner from the photoconductor 145 onto a sheet. The fusing station 159 then receives the sheet from the transfer charger and fuses the toner to the sheet to define a printed sheet.

Referring to FIG. 1, an inverter 131 may be provided in the marking engine 103 to make duplex sheets. The inverter 131 is not used when a duplex sheet is not to be produced. The inverter 131 includes an inverter paper transport 137, which may be any suitable mechanism for inverting the sheets. The inverter 131 turns the duplex sheet upside down prior to transferring the duplex sheet onto the input paper transport 135. The inverter 131 may have a transfer tray (not shown) or similar device to assist inverting the duplex sheet. After a first image is transferred onto a first side of a duplex sheet, the duplex sheet exits the imaging unit 121 on the output paper transport 139. The duplex sheet is then diverted onto the inverter paper transport 137, which inverts the duplex sheet and delivers the duplex sheet to the input paper transport 135. The duplex sheet enters the imaging unit 121 where a second image is transferred onto a second side of a duplex sheet. The duplex sheet exits the imaging unit 121 and the marking engine 103 on the output paper transport139 which is the output of the marking engine 103, bypassing the inverter 137.

Figure 3:
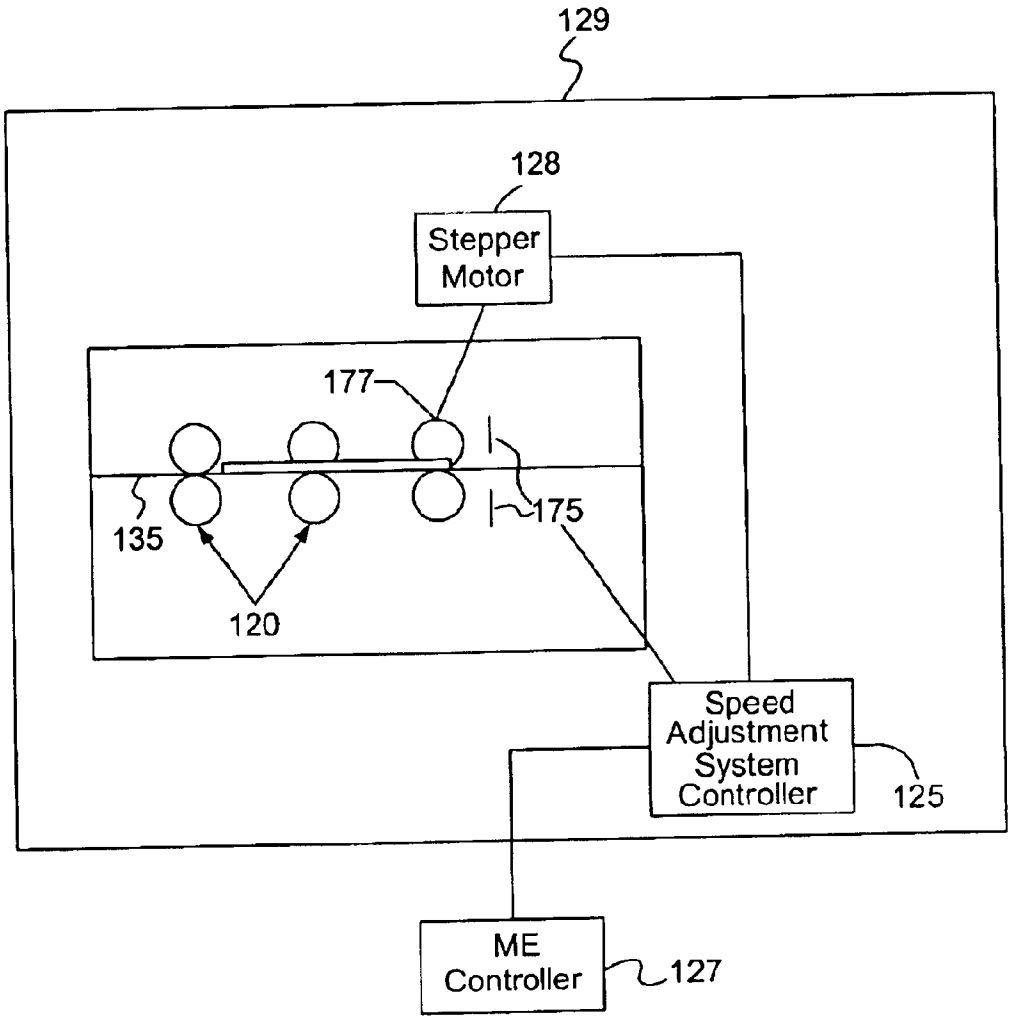
FIG. 3 is a schematic diagram of a preferred embodiment of a speed adjust system.

The electrophotographic printer also includes a speed adjust system. FIG. 3 is a schematic diagram of a preferred embodiment of a speed adjust system 129. As discussed, the speed adjust system 129 is located upstream of the registration system 176. In this embodiment, speed adjust system 129 includes upstream nip rollers 120, at least one speed adjust sensor 175, speed adjust rollers 177 and speed adjust controller 125. In addition, speed adjust system 129 is operatively connected to the marking engine controller 127. The speed adjust sensor 175 is operatively connected to the speed adjust system controller 125. The speed adjust system controller 125 controls the operation of the speed adjust system 129 based on information the speed adjust system controller 125 receives from the speed adjust sensor 175. In the preferred embodiment, the speed adjust system 129 corrects the timing of sheets for paper feeders A, inverter 131, 43*a*, 143*b*, 143*c* prior to delivering the sheets to the registration system 176 in a manner described in more detail below.

In this embodiment, the speed adjust rollers 177 are connected by a least one belt and pulleys to a stepper motor 128 that is connected to the speed adjust system controller 125. The speed adjust system controller 125 uses the stepper motor 128 to control the speed adjust rollers 177 to correct the timing of sheets arriving at the registration system 176. In this manner, the speed adjust system 129 feeds the sheet at an adjusted speed and preferably with adjusted timing into the registration system 176, which accurately positions the paper for image transfer at the imaging unit 121. In a preferred embodiment, the speed adjust system controller 125 is located inside or part of the marking engine controller 127.

Preferably, the marking engine controller 127 is connected to a user interface that allows a user to control the operation of the image-forming machine. The user interface may be a graphical user interface or any suitable user interface.

FIG. 2 is a schematic diagram of a preferred embodiment of an inserter and a finisher device of the image-forming production system. Sheets exiting the marking engine 103 on the output paper transport 139 are then transferred to a pass-through paper transport 163 as the sheets enter the inserter 105. The output paper transport 139 and the pass-through paper transport 163 forms a sheet output path and may be the same paper transport. The sheet output path may include the output paper transport 139 or may include other paper transports, such as one or more finisher paper transports 173*a*, 173*b*, and 173*c*.

The inserter 105 is an auxiliary paper module that merges sheets from the insert supplies with those coming from marking engine 103 upstream from the finisher device 107. If there are no inserted sheets in the image-forming job, the sheets exit the inserter 105 and enter the finisher device 107. If there are inserted sheets, the inserter 105 places the inserted sheets between the appropriate output sheets from the marking engine 103.

Preferably, the inserter 105 includes insert storage bins 165*a*, 165*b*, and 165*c* having paper feeders 167*a*, 167*b*, and 167*c*, respectively. As with the insert bins, there may be only one or other multiples of insert paper feeders. At the appropriate position in the sheet output from the marking engine 103, an inserted sheet position, one or more of the paper feeder(s) 167*a*, 167*b*, and 167*c* provides inserted sheets to the insert paper feeder 169 from one or more of the storage bins 165*a*, 165*b*, and 165*c*. The paper feeders 167*a*, 167*b*, and 167*c* extract an inserted sheet from the storage bins 165*a*, 165*b*, and 165*c* and dispense the inserted sheet onto the inserter paper transport 169.

Insert paper transport 169 provides a means for transferring the one or more sheets (plurality of sheets) onto a pass-through paper transport 156. The paper transports 156 and 169 operate in conjunction with paper transport rollers 119*b*, of which any one or more may be a motor driven roller. The paper transport rollers 119*b* may be configured in pairs oppositely disposed on the paper transports 156 and 169. The paper transport rollers 119*b* may have other configurations known in the art suitable for moving the sheets. Alternatively, the paper transports 156 and 169 may provide a passage or path for the sheets to follow. The paper transport rollers 119*b* may be disposed such that at least one roller or one pair of rollers is in contact with each sheet at any position along paper transports 156 and 169.

Paper transport 156 transfers the one or more inserted sheets from the inserter 105 to paper transport 171 of the finisher device 107. The insert paper transport 169 provides the inserted sheets onto the pass-through paper transport 156. Paper transport 156 transfers the one or more inserted sheets from the inserter 105 to paper transport 171 of the finisher device 107. The inserter paper transport 169 provides the inserted sheets onto the pass-through paper transport 156.

The sheet storage bins 165*a*, 165*b*, and 165*c* hold inserted sheets, which may be blank, preprinted, and the like. The inserted sheets may be the same size, different sizes, and a combination of sizes. The inserted sheets may be the same, different, and a combination of paper and other medium. The inserted sheets may be the same size as or a different size from the sheets provided by the feeder assembly 123 to the imaging unit 121. The inserted sheets also may be the same paper or other medium as the sheets provided by the feeder assembly 123.

Preferably, a finisher device 107 is provided that collects the sheet output to complete the image-forming job or prepare it for subsequent processing operations, such as stapling, binding, collation and the like. In the finisher device 107, the sheets are transferred onto one of the finisher device paper transports 173*a*, 173*b*, and 173*c*. Each of the finisher device paper transports 173*a*, 173*b*, and 173*c* may lead to one or more finishing operations (not shown), such as stapling, binding, collation, and the like. One of the finisher paper transports 173*a*, 173*b*, and 173*c* may be the same as the pass-through paper transport 171. The finisher device 107 transfers the sheets to an output accessory 109, which is used to facilitate the presentation of the sheets in a document or a print job in any particular manner. One or more optional output accessories 109 may be located downstream of the finisher device 107.

Figure 5:
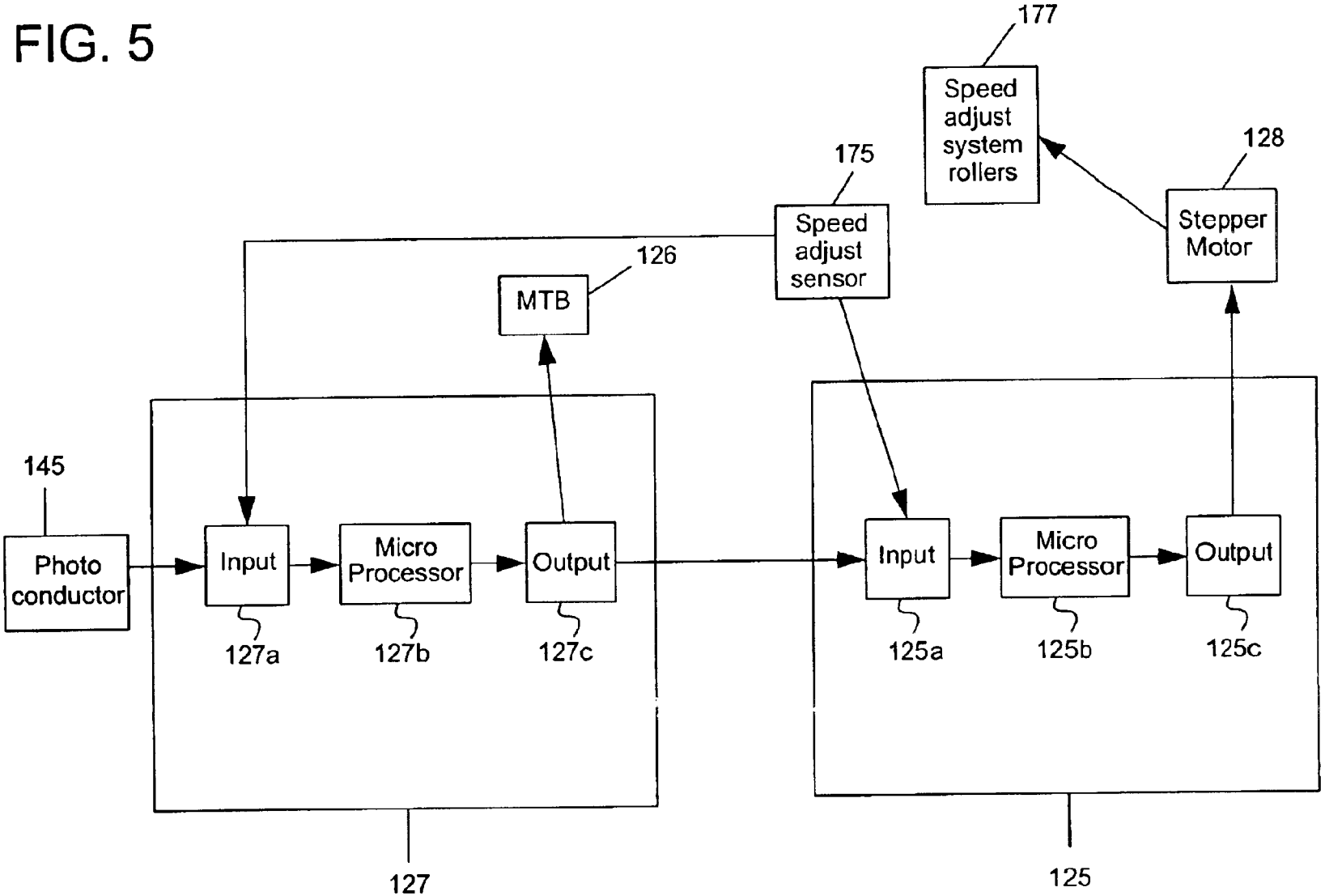
FIG. 5 is a schematic diagram of a preferred embodiment of a speed adjust system controller and a marking engine controller.

FIG. 5 is a schematic diagram of a preferred embodiment of a speed adjust system controller connected to the marking engine controller. The speed adjust system controller 125 is a device that interacts with the other components of the speed adjust system 129 to measure arrival time of one sheet or a plurality of sheets at the speed adjust system 129. For example, the speed adjust system controller 125 controls the movement of the plurality of sheets in the speed adjust system 129 by controlling the stepper motor 128, which controls the movement of the speed adjust rollers 177 shown in FIG. 2. The marking engine (ME) controller 127 is responsible for coordinating the actions of several subsystems within the marking engine 103, including the imaging unit 121.

The ME controller 127 includes an input interface 127*a*, an output interface 127*c* and a microprocessor 127*b*. In a preferred embodiment, the microprocessor 127*b* is an M68332 processor. The ME controller 127 is connected through its input interface 127*a* to various components and sensors in the marking engine 103, such as a sensor input (not shown) that is adjacent to a photoconductor 145 of imaging unit 121. The sensor input senses perforations or indexes on the photoconductor loop 145. Each time the sensor input senses a perforation on the photoconductor 145, the input interface 127*a* receives a signal corresponding to the perforation and the microprocessor 127 generates an F-PERF signal. The microprocessor 127*b* sends the F-PERF signal through an output interface 127*c* to a machine timing bus (MTB) 126. Rollers 147 include an encoder. The rollers 147 drive the photoconductor 145. The encoder generates 600 encoder counts for each inch the photoconductor 145 travels. The ME controller 127 is connected by the input interface 127*a* to the encoder so the ME controller 127 receives encoder counts and through its output interface 127*c* places the counts on the MTB 126. The input interface 127*a* also monitors the actions of the subsystems for fault conditions in the wiring of the subsystems.

Preferably, the MTB 126 is a digital circuit, which provides a means to coordinate the timing of the subsystems in marking engine 103. The Input interface 127*a* also performs other functions, such as receiving information from other subsystems in the marking engine 103, for example, the imaging unit 121.

The output interface 127*c* is responsible for taking commands from microprocessor 127*b*, and putting them into a form capable of operating the various subsystems in the marking engine, such as the imaging unit 121.

The microprocessor 127*b* may also includes a clock/timing circuit, an electronic erasable program read only memory (EEPROM) or flash memory, static random access memory (RAM) and a read only memory (ROM). The microprocessor 127*b* also includes a software program that enables it to continuously monitor and read measurements from the input interface 127*a* connected to various systems in the marking engine 105, such as the sensor input on the photoconductor 145.

The speed adjust system controller 125 includes an input interface 125*a*, a microprocessor 125*b*, and an output interface 125*c*. In a preferred embodiment, the microprocessor 125*b* is an 8051 processor. The speed adjust system controller 125 is connected by its input interface 125*a* to speed adjust sensor 175 in the speed adjust system 129. When a leading edge of each sheet of the plurality of sheets contacts the speed adjust sensor 175, the speed adjust sensor 175 sends a signal to the speed adjust system controller 125. Input interface 125*a* is also connected to output 127*c* where input interface 125*a* can receive a synch pulse signal from output 127*c*.

The output interface 125*c* is responsible for taking commands from microprocessor 125*b* and putting it into a form capable of operating the various components, such as the stepper motor 128. The microprocessor 125*b* may also include a clock/timing circuit, an electronic erasable program read only memory (EEPROM) or flash memory, a static random access memory (RAM) and a read only memory (ROM). The microprocessor 125*b* also includes a software program that enables it to measure the time from the synch pulse signal until the time of the signal from the speed adjust sensor 175 as an actual measured time. The microprocessor 125*b* then compares the actual measured time to a nominal time to determine when to decelerate the sheets. In the preferred embodiment, the nominal time is 0.095 seconds. The nominal time is a theoretical time from when a synch pulse signal is sent to the microprocessor 125*b* to when a lead edge of at least one sheet from marking engine 103 should contact the speed adjust sensor 175. This nominal time is preferably determined and stored in the memory of the microprocessor 125*b* of speed adjust system controller 125. The microprocessor 125*b*, through the output interface 125*c* commands the stepper motor 128 to decelerate the speed adjust rollers 177, which decelerates the sheets.

Registration system 176 may also include an input interface (not shown), a microprocessor (not shown) and an output interface (not shown) as in speed adjust system controller 125. However, the microprocessor in the registration system 176 includes a special software program that determines the optimal nominal time relative to a synch pulse of the deceleration of the sheets by the speed adjust rollers 177. Registration system 176 is also operatively connected to marking engine controller 127, where the registration system 176 transmits this optimal nominal time through its output interface to input interface 127*a*. Input interface 127*a* transmits the optimal nominal time through microprocessor 127*b* and output interface 127*c* to input interface 125*a*. Input interface 125*a* transmits the optimal time to microprocessor 125*b* that aligns the sheet.

Figure 4:
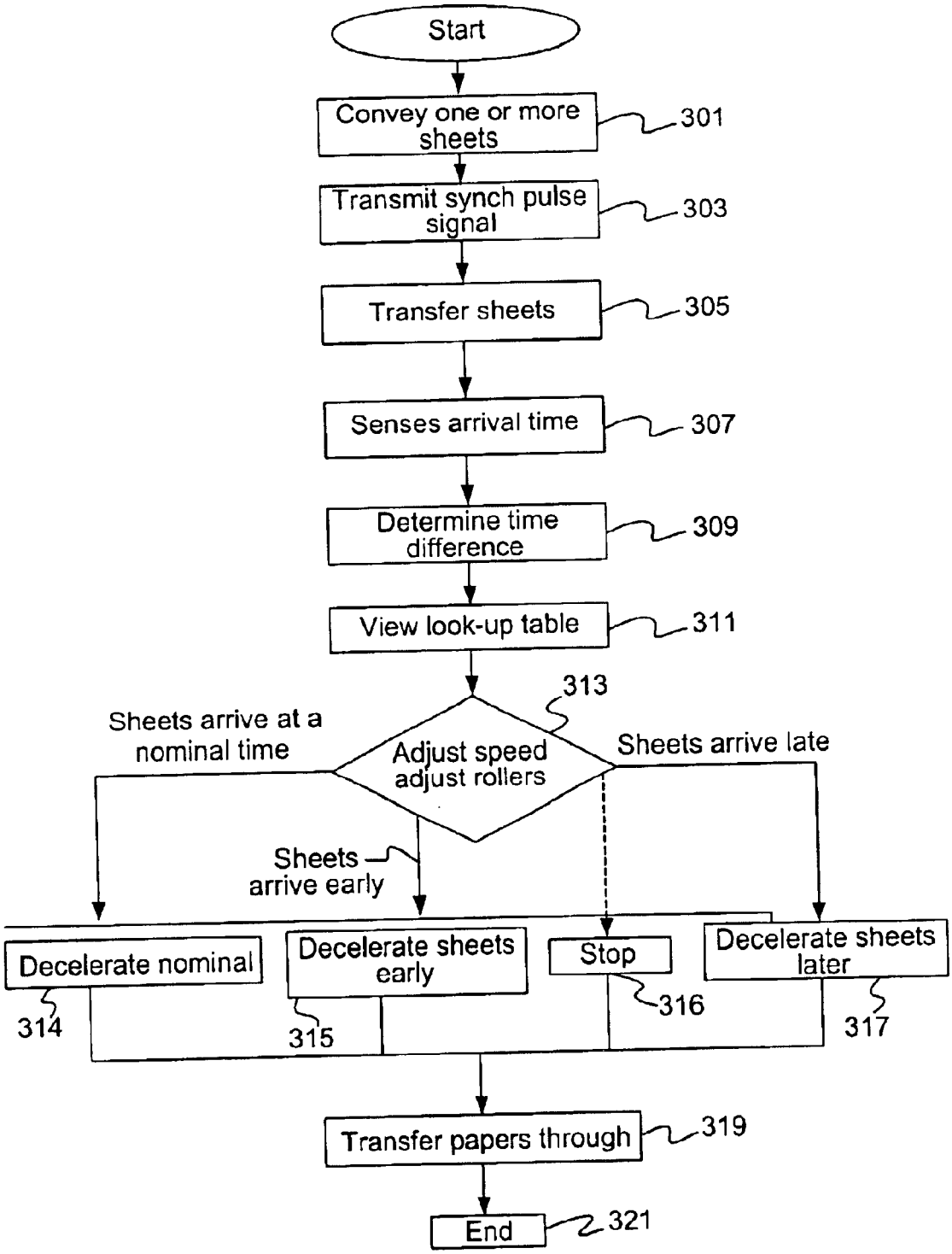
FIG. 4 is a flow chart of an algorithm or method that provides an example of how the invention is utilized in the image-forming production system.

FIG. 4 is a flow chart of an algorithm or method that provides an example of how the invention is utilized in the image-forming production system 100. In the embodiment described here, the speed adjust rollers 177 follow a predetermined velocity profile, transitioning from the input speed to the desired output speed at a time based on the arrival time of at least one sheet from a plurality of sheets at the speed adjust sensor 175.

At 301, at least one sheet or, preferably, a plurality of sheets are traveling or being transferred from paper feeders 143*a*, 143*b* and 143*c* at marking engine 103 paper transports 133, 135 to the speed adjust system 129. The sheets are being transferred at a current speed, for example 66 ips. Nominal feed timing systems in the marking engine 103 control the time the sheets leave and travel to the imaging unit 121. For each of the sheets, after a period of time the ME controller 127, preferably, at its input interface 127*a*, receives 3200 encoder counts after an F-PERF signal.

At 303, after the 3200 encoder counts, the ME controller 127 transmits a synch pulse signal for each of the sheets to the speed adjust system controller 125, if and only if each of the sheets is approaching the speed adjust system 129. The speed adjust system controller 125 receives the synch pulse signal, at an input interface 125*a*, that indicates at least one sheet of the plurality of sheets is approaching the speed adjust system 129. This signal is a basis from which to start measuring a time period. The synch pulse signal also serves as a reference point that indicates when the at least one sheet from the plurality of sheets should be delivered to the imaging unit 121. In this embodiment, the synch pulse signal is used to accelerate the speed of the adjust rollers 177 to the 66 ips speed of the incoming sheet.

At 305, the paper transport 135 transfers the at least one sheet from the plurality of sheets to the speed adjust system 129. After the at least one sheet of the plurality of sheets pass through the upstream nip rollers 120, the leading edge of the at least one sheet comes into contact with the speed adjust sensor 175. When the leading edge of the at least one sheet from the plurality of sheets contacts the speed adjust sensor 175, the speed adjust sensor 175 transmits a signal indicating that there is "paper present" to the speed adjust system controller 125.

At 307, speed adjust sensor 175 senses the arrival time of the at least one sheet from the plurality of sheets passing through the speed adjust system 129 and transmits a signal that indicates an arrival to the input interface 125*a*.

At 309, the microprocessor 125*b* determines an arrival time from the signal from the speed adjust sensor 175. The microprocessor 125*b* then compares the measured arrival time received from the input interface 125*a* to the synch pulse signal and determines a time difference to the nominal time between the synch pulse signal and the arrival time.

At 311, the microprocessor 125*b* either uses a calculation or a look up table stored on system adjust controller 125 to look up the measured time and find a time (an adjust time) to transition the speed adjust rollers from the 66 ips first input speed to the desired second output speed of the at least one sheet from the plurality of sheets, for example 33 ips.

At 313, based on the measured time, microprocessor 125*b* connected through an output interface 125*c*, to the stepper motor 128, instructs the stepper motor 128 to decelerate the speed adjust rollers 177 to the 33 ips speed so that the at least one sheet from the plurality of sheets arrive at the registration system 176 correlate with the timing of the photoconductor 145 at the imaging unit 121. Depending on the arrival time of the at least one sheet from the plurality of sheets at the speed adjust system 129, there are four ways that the at least one sheet may be decelerated as shown in options 314, 315, 316 and 317.

At 314, the at least one sheet arrives at the nominal time and the speed of the speed adjust rollers177 is decelerated from the 66 ips to 33 ips according to the calculated time to feed the at least one sheet to the registration system at the appropriate timing.

Since the at least one sheet from the plurality of sheets must arrive at the registration system 176 at consistent timing intervals, if the at least one sheet arrives early or late relative to the nominal time, the speed adjust system 129 will also adjust the timing of the sheets exiting the speed adjust rollers 177. If the at least one sheet arrives early as shown at 315, the microprocessor 125*b* instructs the speed adjust rollers 177 to decelerate the sheet earlier. In this manner, the at least one sheet from the plurality of sheets are driven at the lower speed for a longer time in order to delay the sheet the appropriate amount. In an example, if the leading edge of the at least one sheet is detected at the speed adjust system sensor 175 at 90 milliseconds after the synch pulse signal is sent to the speed adjust system controller 129, then the speed adjust system controller 129 instructs the stepper motor 128 to decelerate the speed adjust rollers 177 at (45+(90-95)=40 milliseconds after the at least one sheet is detected by the speed adjust system sensor 175.

If the at least one sheet from the plurality of sheets arrive later than the nominal time, as shown at 317, the microprocessor 125*b* instructs the speed adjust rollers 177 to decelerate the sheet later. In this manner, the sheet is driven at the higher speed for a longer time in order to make up the timing difference. For example, if the leading edge of at least one sheet of the plurality sheets is detected at the speed adjust system sensor 175 at 100 milliseconds rather than the nominal time of 95 milliseconds, then microprocessor 125*b* instructs the stepper motor 128 through the speed adjust rollers 177 to decelerate the at least one sheet 50 milliseconds after it is detected by the speed adjust unit sensor 175. The following calculation is used to determine when the speed adjust rollers 177 should decelerate the sheets: (45+(100−95)=50 milliseconds).

In this embodiment, the maximum theoretical adjustment range is determined by the difference in input and desired speeds, the distance from the speed adjust sensor 175 and an entrance sensor (not shown) to the downstream device, and the distance required to decelerate the sheet.

In another embodiment, the timing latitude is increased by using a larger speed differential for the speed adjust rollers177. In this embodiment, the speed of the speed adjust rollers177 is controlled to levels that are higher than the input speed for the sheets that arrive too late to otherwise correct. For instance, for every millisecond the sheets are transported at 3 times the output speed of 99 ips, 2 milliseconds will be saved.

Similarly, the at least one sheet from the plurality of sheets are driven at a speed lower than the output speed for sheet that arrives too early. For example, if the at least one sheet from the plurality of sheets arrive too early to correct by decelerating the output speed of the speed adjust rollers 177 to 33 ips immediately after the sheet arrive at the speed adjust sensor 175, the speed adjust system controller 125 can instruct the speed adjust rollers 177 to slow down the at least one sheet to a speed even less than that of the output speed of 33 ips to compensate for the additional "earliness" of the at least one sheet from the plurality of sheets. If the speed adjust rollers 177 are moving at a speed less than the output speed of 33 ips, more time will be used to transport the at least one sheet the same distance and thus the "early" the at least one sheet from the plurality of sheets can be corrected. Therefore, the speed of the at least one sheet from the plurality of sheets will be accelerated by the speed adjust rollers 177 to 33 ips and be fed to the registration system 176 at the appropriate time. This increases the latitude, based on the torque limitations of the motor and the distance required accelerating and decelerating to and from these higher and lower speeds.

In another embodiment, the sheet is stopped at the speed adjust system 129 for a period of time, as illustrated at 316 in FIG. 5. In this embodiment, the sheet is stopped through a predetermined velocity profile after the leading edge is detected by the speed adjust sensor 175. At 316, the sheets are stopped or delayed when microprocessor 125*b* transmits instructions to the speed adjust rollers 177 to stop the sheets after a leading edge of the sheet of the plurality of sheets contacts the speed adjust sensor 175. Preferably, this stop may occur for about 5-50 milliseconds. The sheets remain delayed until a pre-determined time after the synch pulse signal, which automatically compensates for the arrival time of the sheets at the speed adjust system 129. After the pre-determined time, microprocessor 125*b* through the output interface 125*c* instructs the stepper motor 128 to move the speed adjust rollers 175, which makes the at least one sheet from the plurality of sheets move at 33 ips towards the imaging unit 121. This method is aggressive on the paper and mechanism, but it has very wide timing latitude. This control scheme is appropriate for systems with larger timing variations or a short distance, such as from an external feed source like a roll feed/sheeter.

Since the speed adjust system 129 has a finite input timing latitude, it is desirable to optimize the nominal feed timing for each of the feed sources. If the propensity for the at least one early sheet from the plurality sheets is the same as that of the late sheet, the timing should be adjusted so as to center the adjustment latitude for early and late sheets. In this case, the optimum nominal sheet arrival time is halfway between the nominal actuation of the speed adjust sensor 175 and the latest point in time the deceleration of the sheets can be initiated by the speed adjust rollers 177 and still have the sheets arrive at the desired speed of 33 ips at the imaging unit 121. This optimum nominal sheet arrival time is about 0.095 seconds±0.032 s. In this embodiment, the deceleration of the at least one sheet from the plurality of sheets is forced to occur nominally relative to the arrival of the sheet at the speed adjust sensor 175, regardless of the actual arrival time. When a number of sheets from the plurality of sheets are fed from one of the paper supplies, for example the marking engine 103, then the average arrival time at the registration system 176 is measured. Once the average arrival time is determined, then a paper supply feeding time of the marking engine 103 can be changed so the at least one sheet from the plurality of sheets nominally arrive at the speed adjust system 129.

Referring to FIG. 5, the speed adjust rollers 177 require peripheral devices to accelerate or decelerate the sheets, such as solenoid clutches (not shown), a solenoid (not shown), a small motor (not shown) and low force rollers (not shown) all of which are positioned next to and operatively connected to upstream nip rollers 120. For example, the input interface 127*b* receives information if "paper is present" signal by its connection with the speed adjust sensor 175. Input interface 127*b* transmits the signal to the microprocessor 127*b*, which instructs the output interface 127*c* to adjust the speed of the speed adjust rollers 177. Microprocessor 127*b* transmits the instructions through output interface 127*c* to a connection with the solenoid clutches to force the upstream nip rollers 120 to disengage the at least one sheet from the plurality of sheets passing on paper transport 135 so speed adjust rollers 177 can adjust the travel speed of the sheet. In another example, the microprocessor 127*b* transmits instruction through the output interface 127*c* to a connection with the solenoid or a small motor to open up the nip rollers 120 to allow the speed adjust rollers 177 to adjust the travel speed of the sheet. In yet another example, the low force rollers let the sheet slip through it but it cannot stop the sheet from passing through it so the speed adjust rollers 177 are able to adjust the travel speed of the sheet.

It should be noted that a sheet larger than normal may require special consideration. In particular, if the sheet is large enough where a trail edge of the sheet can not be released when the sheet normally decelerates or slows down, then the sheet requires special consideration. For example, in the case where the sheet is larger than normal, for example the size of the paper is 18 inches, then the deceleration of the sheet by the speed adjust rollers 177 can not occur when the speed adjust sensor 175 contacts at the leading edge of the at least one sheet from the plurality of sheets. The deceleration of the at least one sheet must occur after the at least one sheet has cleared the upstream nip rollers 120 when the leading edge of the sheet is close to the registration system 176. The microprocessor 127*b* delays the timing of the feed in the sheets from the paper supply or paper feeder 143*b* to the speed adjust rollers 177, which results in delaying the deceleration of the sheet. The sheet may also be delayed from paper feeder 143*a*, 143*c*, A, 131 or wherever the feeder sheet is located.

Referring to FIG. 4, in a preferred embodiment, the distance between the speed adjust rollers 177 and the registration roller 176 should be about 7-8 inches. This distance is optimal because this distance ensures that the leading edge of at least one sheet from the plurality of sheets arrives at the registration system 176 before a trail edge of the sheet leaves the speed adjust rollers 177. When the leading edge of the at least one sheet from the plurality of sheets extends out about an inch from the registration system 176, then the trail edge of the sheet should leave the speed adjust rollers 177 and the registration system 176 is able to orient and position the at least one sheet appropriately for an image to be imprinted on them.

At 319, the at least one sheet from the plurality of sheets completely pass through the speed adjust system 129 on its way to the registration system and the process ends at 321.

Figure 6:
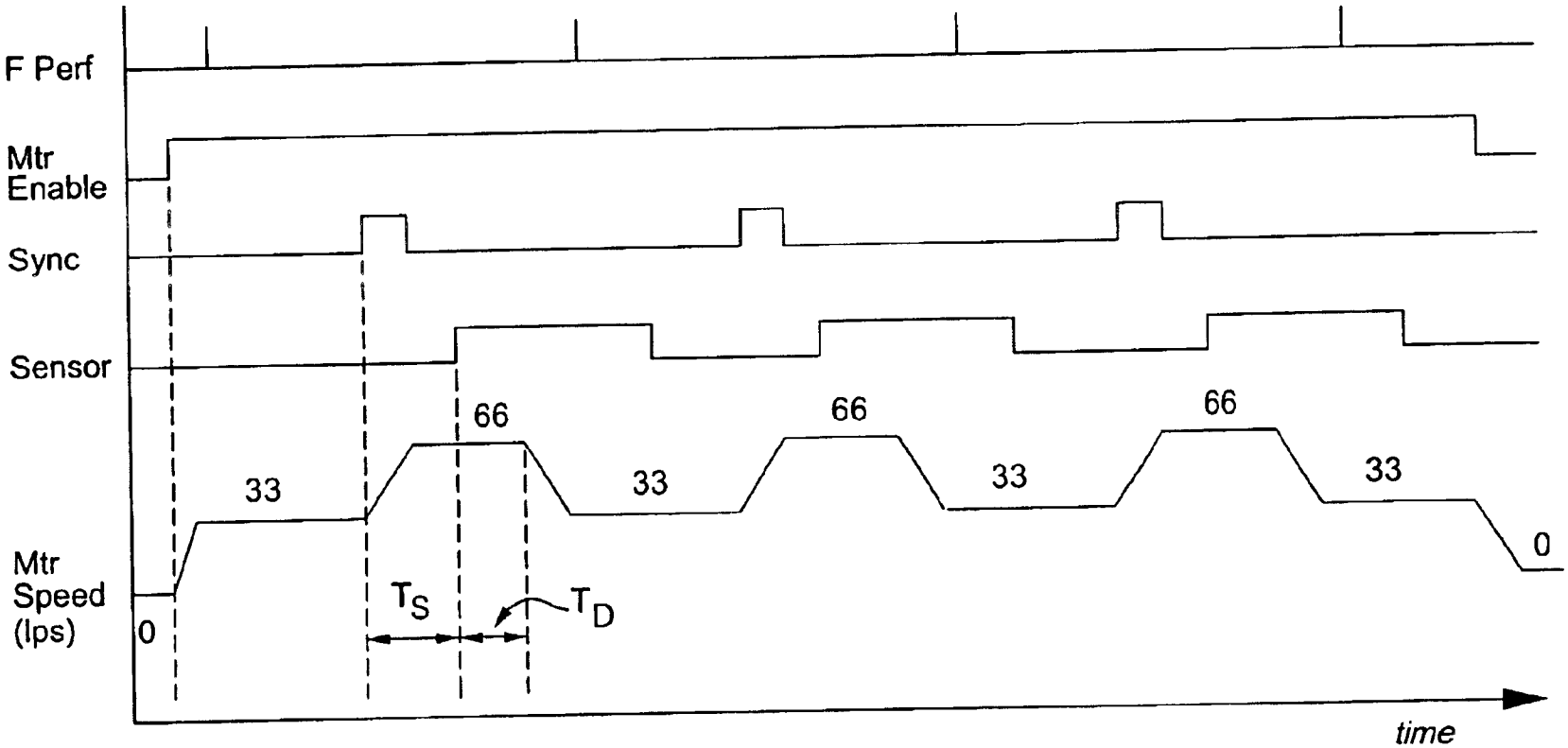
FIG. 6 is a timing diagram of the speed adjust system of FIG. 3.

FIG. 6 is a timing diagram of the speed adjust system. As stated above, as the photoconductor 145 travels around the rollers 147, F-PERF signals are generated and sent to the microprocessor 127*b*. The microprocessor 127*b* of the ME controller 127 generates the synch pulse signal (sync) at a fixed time relative to the F-PERF signals, when the leading of at least one sheet from the plurality of sheets approaches the speed adjust system 129. The microprocessor 127*b* also enables the speed adjust system 129 via the microprocessor 125*b* to enable a signal (Mtr Enable) for the stepper motor 128, which causes the speed adjust system controller 125 to energize the stepper motor 128 and wait for the first sync pulse signal. When the stepper motor 128 is enabled, the stepper motor 128 speed increases from 0 ips to 33 ips. When the first sheet or the at least one sheet from the plurality of sheets approaches the speed adjust system 129, the synch pulse signal is generated and the stepper motor 128 speed increases to 66 ips. Next, the speed adjust system 129 waits until the sheet contacts or actuates the speed adjust sensor 175 (sensor). When the sheet contacts the speed adjust sensor 175, then the microprocessor 125*b* measures the time between the sync pulse signal and the sensor actuation (Ts). The microprocessor 125*b* varies the time before deceleration (Td) based on Ts. For example, if the sheet contacts the speed adjust sensor 175 early, then Ts will be smaller than desired and Td will be short. Therefore, the sheet decelerates earlier. If the sheet contacts the speed adjust sensor late, then Ts will be larger than the desired and Td will be large. Therefore, the sheet decelerates later. In either case, the arrival of the sheet at the registration system will be corrected.

There may be variations in the distance between the speed adjust sensor 175 and the registration system 176. Similarly, there may be variation in the speed of the marking engine 103. These variations affect the optimal time between the synch pulse and the desired delivery of the sheet to the registration system 176. One way to compensate for this is to fine tune the timing of the synch pulse. This can be accomplished through a special software program similar to the one used to adjust the feed timing for the feed sources. In this case, the speed adjust system 129 will be enabled and compensate for sheet timing as it does in normal operation. When a number of sheets are fed from any one of the paper supplies, for example the marking engine 103, then the average arrival time at registration system 176 is measured. Once the average arrival time is determined, then the timing of the synch pulse signal sent by the marking engine controller 127 can be changed so the sheets nominally arrive at the registration system 176. If the speed of the marking engine 103 were to vary over time, it could be measured and compensated for by modifying the timing of the synch pulse. In a preferred embodiment, this change is compensated for by the following method. First, the change in sheet timing relative to marking engine speed is characterized. Next, a compensation algorithm is approximated by a linear relationship between the marking engine speed and synch pulse timing. The machine speed is calculated from the MTB signal at the start of each run and compared to the machine speed when the synch pulse adjustment program was invoked. Thus, the synch pulse timing is modified when there is a variation in the speed of the marking engine 103 and variations in the distance between the speed adjust sensor 175 and the registration system 176.

The speed adjust system of the present invention thus provides several advantages over conventional systems. The system enables the paper supplies to feed the sheets at speeds higher than the registration can accept. This allows more time for sheet acquisition by the vacuum feed heads. The system also minimizes sheet to sheet timing variability for sheets delivered to the registration system. Also, the system of the present invention enables the use of an auxiliary feed device that have more feed timing variability than tightly integrated marking engine and paper supplies.

It is intended that the foregoing detailed description be regarded as illustrative rather than limiting, and that it be understood that it is the following claims, including all equivalents, that are intended to define the spirit and scope of this invention.

What is claimed is:

1. An image production system, the system comprising:

a marking engine that receives at least one sheet onto which an image is transferred, the marking engine including an imaging system that transfers the image onto the at least one sheet;

a sheet feeder that feeds the at least one sheet to the marking engine at a first speed;

a registration system that aligns and moves the at least one sheet on the imaging system at a second speed, the marking engine having an output downstream of the imaging system; and a speed adjust system upstream of the registration system, the speed adjust system connected to receive the at least one sheet from the sheet feeder at the first speed and output the at least one sheet to the registration system at the second speed.

2. The image production system of claim 1 wherein the speed adjust system adjusts the timing at which the at least one sheet is output to the registration system to refine the timing at which the at least one sheet is outputted to the registration system.

3. The image production system of claim 1 wherein:

the marking engine transmits a synch pulse signal indicating a nominal time when the at least one sheet is to arrive at the speed adjust system;

the speed adjust system determines the actual arrival time of the at least one sheet at the speed adjust system; and the speed adjust system compares the synch pulse signal to the actual arrival time and uses the comparison to determine an adjust time when the speed adjust system changes the speed of the at least one sheet from the first speed to the second speed.

4. The image production system of claim 3 wherein the speed adjust system decelerates the at least one sheet from the first speed to the second speed and (1) if the at least one sheet arrives earlier than the nominal time, the speed adjust system changes from the first speed to the second speed earlier than the adjust time and (2) if the sheet arrives later than the nominal time, the speed adjust system changes from the first speed to the second speed later than the speed adjust time.

5. The image production system of claim 3 wherein the speed adjust system changes the speed of the at least one sheet to a third speed different from the first and second speeds before the speed is changed to the second speed.

6. The image production system of claim 3 wherein the speed adjust system first stops the at least one sheet after it is received and then adjusts the speed from the stopped speed to the second speed.

7. An image production system, the system comprising:

a marking engine that receives at least one sheet, the marking engine including a marking engine controller, wherein images are formed on the sheet, a registration system upstream of an imaging system, wherein the registration system aligns the at least one sheet for the marking engine;

a speed adjust system including a speed adjust system controller;

wherein the marking engine controller transmits a synch pulse signal to the speed adjust system controller when the sheet approaches the speed adjust system;

the speed adjust system being configured to transmit a signal to the speed adjust system controller of an arrival of the sheet; and the speed adjust system controller being configured to determine a measured arrival time of the at least one sheet and compare the measured arrival time with the synch pulse signal to adjust a speed of the sheet before the sheet is transferred to the registration system.

8. The image production system of claim 7, wherein the speed adjust system comprises speed adjust rollers and at least one speed adjust sensor.

9. The image production system of claim 8, wherein the speed adjust sensor is configured to transmit the signal to the speed adjust controller when the sheet contacts the speed adjust sensors.

10. The image production system of claim 7 further comprising a stepper motor to adjust the speed of the speed adjust system.

11. The image production system of claim 10, wherein the stepper motor is connected to the speed adjust rollers, and the stepper motor controls the speed adjust rollers to adjust the speed of the at least one sheet.

12. A method of compensating for the variability of an arrival time of at least one sheet in an image production system, the image production system including an imaging system and a registration system, the method comprising:

transmitting the at least one sheet to the registration system;

generating a synch pulse signal used to indicate a nominal time when the at least one sheet is to arrive at a speed adjust system disposed upstream of the registration system;

sensing and determining the arrival time of the at least one sheet at the speed adjust system and generating a measured arrival time signal indicating the arrival time;

comparing the synch pulse signal with the measured arrival time signal to determine a time difference between the synch pulse signal and the measured arrival time signal; and adjusting a travel speed of the at least one sheet from a first speed to a second speed based on the time difference at a speed adjust system;

transmitting the at least one sheet from the speed adjust system at the second speed to the registration system;

at the registration system receiving the at least one sheet at the second speed and adjusting at least one of the skew, timing and crosstrack position of the at least one sheet for delivery to the imaging system; and transferring an image to the at least one sheet.

13. The method of claim 12, wherein adjusting comprises changing the travel speed of the at least one sheet by decelerating the travel speed of the at least one sheet.

14. The method of claim 12, wherein the adjusting comprises at the speed adjust system decelerating the at least one sheet from the first speed to the second speed at a speed adjust time for sheets arriving at the nominal time and (1) if the at least one sheet arrives earlier than the nominal time, changing from the first speed to the second speed earlier than the adjust time and (2) if the sheet arrives later than the nominal time, changing from the first speed to the second speed later than the speed adjust time.

15. The method of claim 14 wherein the speed adjust system changes the speed of the at least one sheet to a third speed different from the first and second speeds before the speed is changed to the first speed.

16. The method of claim 15 further comprising stopping the at least one sheet after it is received at the speed adjust system before it adjusts the speed to the second speed.

17. The method of claim 12 wherein the speed adjust system decelerates the at least one sheet from the first speed.

18. The method of claim 12 further comprising adjusting the timing at which the at least one sheet is output from the speed adjust system to the registration system to refine the timing at which the at least one sheet is output to the registration system.

* * * * *